US011825966B2

(12) United States Patent
Lin

(10) Patent No.: US 11,825,966 B2
(45) Date of Patent: Nov. 28, 2023

(54) CUP LID

(71) Applicant: XIAMEN WORTHFIND INDUSTRIAL CO, LTD., Fujian (CN)

(72) Inventor: Lijuan Lin, Fujian (CN)

( * ) Notice: Subject to any disclaimer, the term of this patent is extended or adjusted under 35 U.S.C. 154(b) by 0 days.

(21) Appl. No.: 18/134,578

(22) Filed: Apr. 14, 2023

(65) Prior Publication Data

US 2023/0248165 A1 Aug. 10, 2023

(30) Foreign Application Priority Data

Nov. 10, 2022 (CN) ..... 202223003191.6

(51) Int. Cl.
*A47G 19/22* (2006.01)
*B65D 47/24* (2006.01)

(52) U.S. Cl.
CPC ..... *A47G 19/2272* (2013.01); *B65D 47/243* (2013.01)

(58) Field of Classification Search
CPC .. A47G 19/2272; B65D 39/08; B65D 41/026; B65D 43/12; B65D 43/20; B65D 47/2093; B65D 47/26; B65D 47/28; B65D 47/2087; B65D 47/243; B65D 47/286; B65D 2517/0017; B65D 2517/0035; B65D 43/0229; B65D 47/248
USPC ..... 220/713
See application file for complete search history.

(56) References Cited

U.S. PATENT DOCUMENTS

| | | | | |
|---|---|---|---|---|
| 2,320,485 | A * | 6/1943 | Straub | B65D 47/286 222/561 |
| 2012/0125931 | A1* | 5/2012 | Roth | B65D 43/0231 220/254.3 |
| 2017/0121073 | A1* | 5/2017 | Seiders | B29C 45/1657 |
| 2019/0256259 | A1* | 8/2019 | Levy | B65D 47/286 |
| 2020/0231345 | A1* | 7/2020 | Lane | B65D 47/248 |
| 2023/0029205 | A1* | 1/2023 | Omdahl, II | A47G 19/2222 |
| 2023/0159235 | A1* | 5/2023 | Gillespie | B65D 47/286 220/254.1 |

* cited by examiner

*Primary Examiner* — Robert Poon

(57) ABSTRACT

A cup lid that has a lid body and a push piece; a push piece moving groove is formed on the lid body, a drinking opening is formed in the push piece moving groove close to a cup edge; the push piece is slidable in the push piece moving groove in a reciprocating manner and is limited in the push piece moving groove by limiting mechanisms, and the push piece can seal the drinking opening with a sealing element; further, the cup lid contains lifting mechanisms between the lid body and the push piece. The distance between the push piece and the bottom side of the push piece moving groove is adjusted while sliding the push piece, so as to reduce the friction against the sealing element and ensure a clean and hygienic drinking.

11 Claims, 13 Drawing Sheets

CUP LID

BACKGROUND OF THE INVENTION

The present utility model relates to the technical field of drinking cups, and in particular to a cup lid provided with a push piece for opening and closing a drinking opening.

Drinking cups serve as a drinking utensil in people's daily life, and the rim of a cup is generally sealed with a lid for dust prevention and hygienic reasons. However, the removal of a cup lid takes two hands and thus can be troublesome. To make it easier, a structure where a drinking opening on the cup lid can be opened or closed by sliding a push piece has been provided, allowing people to open the drinking opening of the cup lid to drink with one hand by pushing the push piece.

As shown in FIG. 1, an existing cup lid with a push piece is provided. A push piece moving groove 32' is formed on the lid body 3', a drinking opening 31' is formed in the push piece moving groove 32' close to the cup edge, and a push piece 1' is embedded in the push piece moving groove 32' and is limited therein so as to slide in a reciprocating manner. A sealing silica gel 2' is arranged under the push piece 1' at a position under the push piece 1' corresponding to the drinking opening 31' when the drinking opening 31' is in a closed position, and the sealing silica gel 2' can completely seal the drinking opening 31' as the push piece 1' moves to close the drinking opening 31' to prevent accidental spillage of liquid from the drinking opening 31'. However, in order to enable the sealing silica gel 2' to completely seal the drinking opening 31', a large frictional resistance may be generated between the entire piece of sealing silica gel 2' and the push piece moving groove 32' on the lid body 3' as the push piece 1' moves towards the position where the drinking opening 31' is closed, making it inconvenient to push. In addition, abrasion of the sealing silica gel 2' after long use may produce impurities which may easily fall directly into the liquid inside the cup from the drinking opening 31' and eventually being consumed by human body, causing hygienic problem of drinking water.

BRIEF SUMMARY OF THE INVENTION

The present utility model is intended to provide a cup lid with a push piece structure. The push piece, as it moves, can avoid or reduce the abrasion of the sealing silicone material as well as be laborsaving and convenient to use.

In order to achieve the above objectives, the technical scheme of the present utility model is focused on how to reduce or avoid the friction generated between the sealing silicone material and the bottom side of the push piece moving groove when opening and closing the drinking opening with a push piece, and the technical scheme is as follows:

A cup lid, comprising a lid body and a push piece; a push piece moving groove is formed on the lid body; a drinking opening is formed at a bottom side of the push piece moving groove, and the drinking opening is disposed proximal to an edge of the cup lid; the push piece is slidable in a reciprocating manner in the push piece moving groove; the push piece is limited in the push piece moving groove by limiting mechanisms; the push piece is provided with a sealing element to seal or unseal the drinking opening as the push piece slides in different directions in the push piece moving groove; wherein the cup lid further comprises lifting mechanisms arranged between the lid body and the push piece;

the lifting mechanisms comprise oppositely arranged butting parts and lifting parts, and each of the lifting parts is provided with a first position and a second position;

when the push piece is pushed to slide in said reciprocating manner, the butting parts are positioned from being relative to the first positions of the lifting parts to being positioned relative to the second positions of the lifting parts, and vice versa; when the butting parts are positioned from being relative to the first positions to being relative to the second positions, a contact area between the lid body and the push piece together with the sealing element is reduced or eliminated.

Further, each of the butting parts is a protruding structure, whereas each of the lifting parts is a recessed structure; a depth of recess of the first position is greater than a depth of recess of the second position in each of the lifting parts.

Further, each of the butting parts is a protruding structure, whereas each of the lifting parts is also a protruding structure, and a protruding height of the first position is smaller than a protruding height of the second position in each of the lifting parts.

Further, transitional surface is formed between the first position and the second position of each of the lifting parts.

Further, there are at least two sets of said lifting mechanisms, and the two sets of said lifting mechanisms are arranged to be spaced apart from each other along a direction perpendicular to a sliding direction of the push piece.

Further, there are four sets of said lifting mechanisms; and the four sets of said lifting mechanisms are arranged and spaced apart evenly between the lid body and the push piece.

Further, each of the lifting parts further comprises a third position, and the third position is located at one end of the second position away from the first position; a depth of recess of the third position is greater than the depth of recess of the second position.

Further, each of the butting parts is a protruding knob, and curved chamfers are formed on two sides of the protruding knob corresponding to the sliding direction of the push piece.

Further, the butting parts are arranged on the bottom side of the push piece moving groove, while the lifting parts are arranged oppositely on a bottom side of the push piece facing towards the bottom side of the push piece moving groove.

Further, the butting parts are arranged on the bottom side of the push piece, while the lifting parts are arranged oppositely on the bottom side of the push piece moving groove.

Further, the sealing element is a sealing silicone material wrapping lateral sides and an upper side of the push piece; the sealing silicone material forms a sealing ring on a periphery of a bottom side of the push piece.

Further, air holes are formed on the bottom side of the push piece moving groove of the lid body; air passages communicating the air holes with an external environment are formed on the sealing silicone material of the sealing element at lateral sides of the sealing ring.

Further, a through passage is formed on a middle part of the bottom side of the push piece moving groove of the lid body; a through straw opening communicating with the through passage is formed on a middle part of the push piece; a removable plug is arranged above the push piece to seal or unseal the through straw opening.

Further, a through passage is formed on a middle part of the bottom side of the push piece moving groove of the lid body; the limiting mechanisms comprise two sliders arranged at the bottom side of the push piece, and two clamping pieces are arranged on outer sides of the sliders respectively; outer sides of the sliders are in contact with inner walls of the through passage; two ribs are arranged in the through passage, the through passage are divided by the ribs such that two through sliding passages spaced apart from each other are defined between the ribs and the through passage; the sliders are slidably received in the through sliding passages respectively.

Further, a middle part of each of the ribs is bent to make a width of a side of a corresponding through sliding passage away from the drinking opening greater than a width of another side of the corresponding sliding passage proximal to the drinking opening, thereby forming a widened space on the side of the corresponding sliding passage away from the drinking opening.

After the technical schemes described above are adopted, through the arrangement of lifting mechanisms between the push piece and the push piece moving groove of the lid body, the distance between the push piece and the bottom side of the push piece moving groove may be adjusted when the push piece is pushed to slide, so as to avoid the sealing element sliding against the bottom side of the push piece moving groove, enabling a non-contacting movement of the sealing element in the push piece moving groove. This can reduce the friction against the sealing element, and reduce the frictional force and the abrasion against the sealing element, thereby avoiding impurities falling off from the sealing element and ensuring a clean and hygienic drinking.

DETAILED DESCRIPTION OF THE INVENTION

In order to make the objectives, technical schemes and advantages of the embodiments of the present application clearer, the technical schemes in the embodiments of the present application will be clearly and completely described below with reference to the drawings in the embodiments of the present application.

Figure 1:
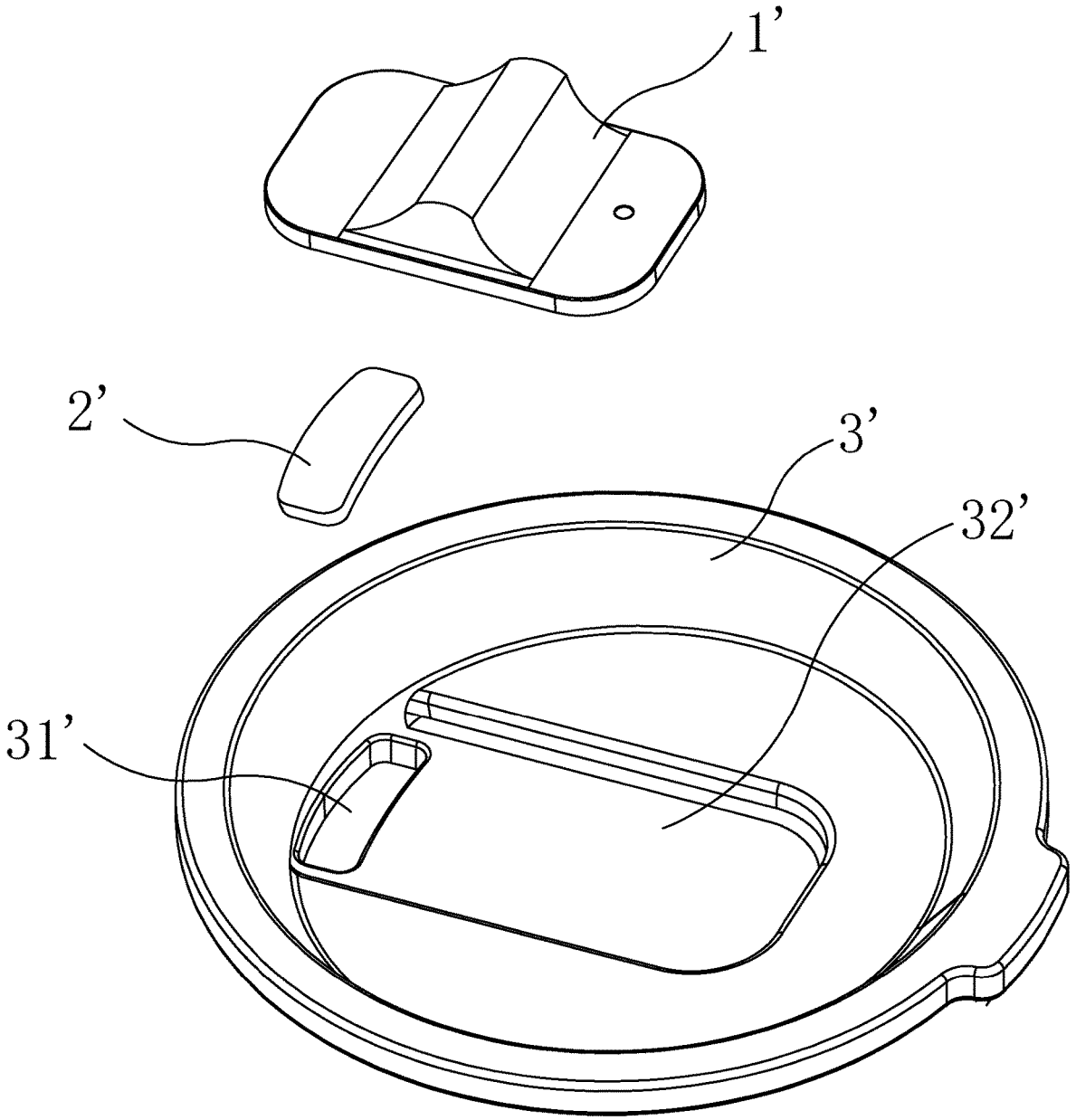
FIG. 1 (Prior Art)
FIG. 1 is a schematic exploded view of an existing cup lid with a push piece.
Figure 2:
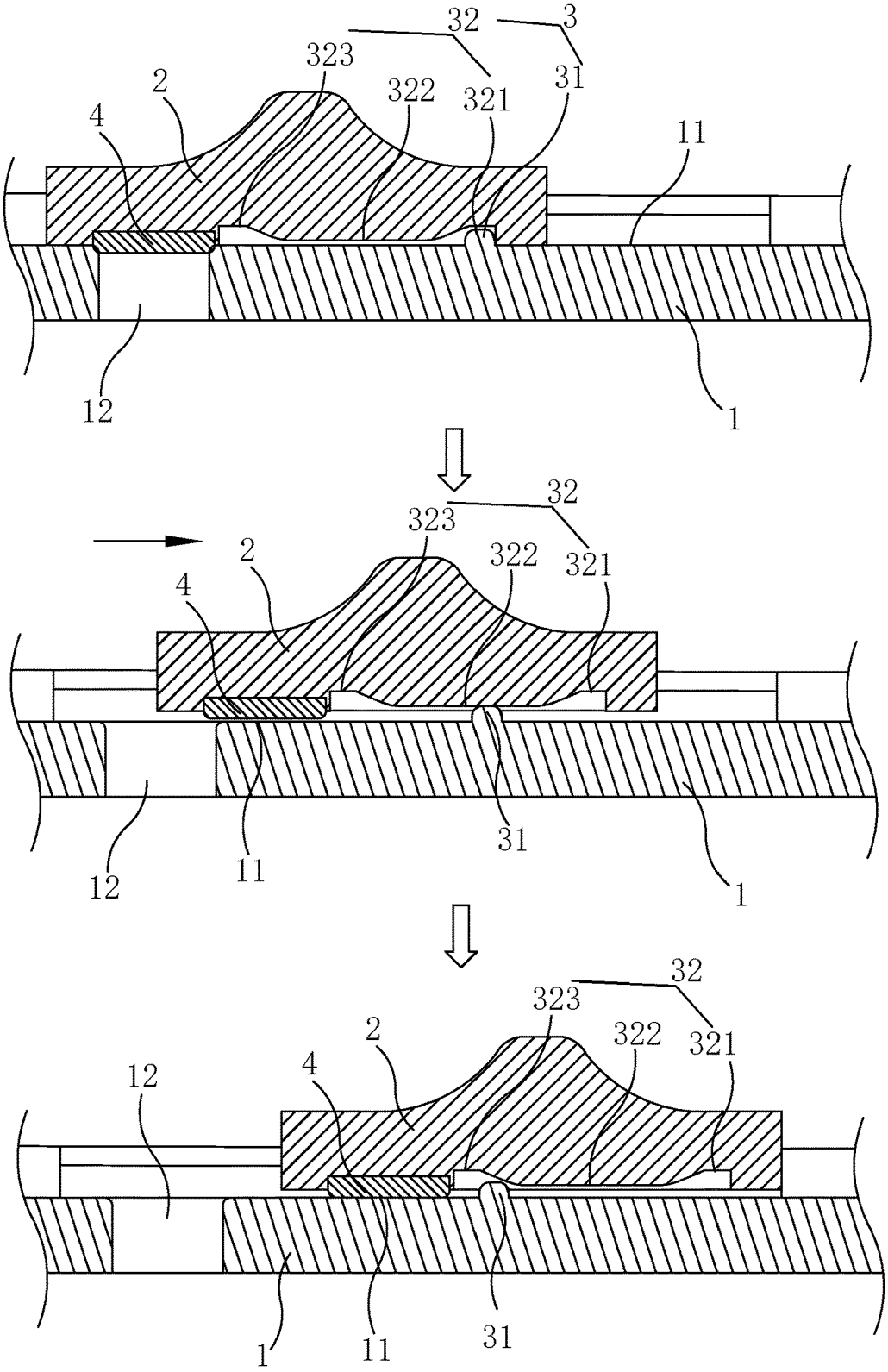
FIG. 2 is a schematic partial sectional view of a cup lid according to the present utility model, showing interactions of the push piece with the lifting mechanisms.

As shown in FIG. 2, a cup lid according to the present utility model is used with a water cup and comprises a lid body 1, a push piece 2, lifting mechanisms 3 and a sealing element 4.

A push piece moving groove 11 is formed on the lid body 1, and a drinking opening 12 is formed at a bottom side of the push piece moving groove 11, and the drinking opening 12 is disposed close to an edge of the cup lid so as to facilitate the pouring of liquid. The push piece 2 is embedded in the push piece moving groove 11 and can slide right and left in a reciprocating manner. Sliding of the push piece 2 enables the push piece 2 to seal or unseal the drinking opening 12 with the sealing element 4, so that the drinking opening 12 may be opened for people to drink, and closed to prevent dust and pollution as well as the spillage of liquid while the cup is toppled.

The lifting mechanisms 3 are arranged between the lid body 1 and the push piece 2, the lifting mechanisms 3 comprise oppositely arranged butting parts 31 and lifting parts 32, and each of the lifting parts 32 is provided with a first position 321 and a second position 322.

Each of the butting parts 31 is a protruding structure, whereas each of the lifting parts 32 is a recessed structure. Each of the lifting parts 32 extends left and right along a moving direction of the push piece 2, and a depth of recess of the first position 321 is greater than a depth of recess of the second position 322 in each of the lifting parts 32, wherein said depth of recess of both the first position and the second position is measured vertically. Pushing the push piece 2 to slide left and right in a reciprocating manner allows the first positions 321 and the second positions 322 of the lifting parts 32 to be positioned relative to the butting parts 31 alternately as the push piece 2 is being pushed back and forth along a left-right direction in said reciprocating manner, thus allowing the butting parts 31 to be positioned relatively to different positions of the push piece 2. In other words, the butting parts 31 initially positioned relatively to the first positions 321 of the lifting parts 32 can be changed to be positioned relatively to the second positions 322 of the lifting parts 32 when the push piece 2 is pushed to slide in one way. Therefore, the push piece 2 and the sealing element 4 are controlled to be in sealing contact with the bottom side of the push piece moving groove 11 and seal the drinking opening 12 when the butting parts 31 are positioned relative to the first positions of the lifting parts 31, and the push piece 2 and the sealing element 4 are being pushed away by the butting parts 31 from the bottom side of the push piece moving groove 11 so as to reduce or eliminate a contact area between the sealing element 4 and the bottom side of the push piece moving groove 11 when the butting parts 31 are positioned relative to the second positions of the lifting parts 32.

In each of the lifting parts 32, the first position 321 is located at a right side of the second position 322, and when the butting parts 31 are located at the first positions 321 which are at the right sides of the lifting parts 32, the push piece 2 is now at an initial position in the push piece moving groove 11 where the push piece 2 is in sealing contact with the bottom side of the push piece moving groove 11, hence sealing the drinking opening 12 with the sealing element 4. In this case, the space between the push piece 2 and the sealing element 4 with the bottom side of the push piece moving groove 11 is reduced or eliminated.

When the push piece 2 is pushed to open the drinking opening 12, the push piece 2 is pushed rightward, and this causes the butting parts 31 to be positioned from being relative to the first positions 321 to being relative to the second positions 322 of the lifting parts 32. The push piece 2 is now controlled to be lifted to make it move upwardly away from the bottom side of the push piece moving groove 11, thus increasing a distance between the push piece 2 and the sealing element 4 relative to the bottom side of the push piece moving groove 11, reducing the contact area between the push piece 2 and the bottom side of the push piece moving groove 11, and reducing the friction between the sealing element 4 and the bottom side of the push piece moving groove 11.

Thus, through the arrangement of the lifting mechanisms 3 between the push piece 2 and the push piece moving groove 11 of the lid body 1, when the push piece 2 is pushed to open the drinking opening 12, the distance between the push piece 2 and the bottom side of the push piece moving groove 11 may be adjusted during the pushing process to avoid the sealing element 4 to be in contact with the bottom side of the push piece moving groove 11 when the sealing element 4 slides in the push piece moving groove 11, thus enabling sliding of the sealing element 4 in the push piece moving groove 11 without the sealing element 4 being in contact with the bottom side of the push piece moving groove 11. This can reduce the friction against the sealing element 4, and reduce the friction of sliding and the abrasion to the sealing element 4, thereby avoiding impurities falling off from the sealing element 4 and ensuring a clean and hygienic drinking.

Each of the lifting parts 32 further comprises a third position 323, and the third position 323 is located at another side of the second position 322 away from the first position 321, i.e., at a left side of the second position 322; a depth of recess of the third position 323 is greater than the depth of recess of the second position 322 and may be the same as the depth of recess of the first position 322. When the push piece 2 seals the drinking opening 12 and is located at a left end of the push piece moving groove 11, the butting parts 31 are positioned at the first positions 321 of the lifting parts 32; when the push piece 2 is pushed to be located at a right end of the push piece moving groove 11, the butting parts 31 are positioned at the third positions 323. When the butting parts 31 are positioned at the third positions 323, the drinking opening 12 is opened, and the push piece 2 is located at an end position of the push piece moving groove 11, and the push piece 2 will sink downwardly to be in contact with the bottom side of the push piece moving groove 11 to prevent the push piece 2 from sliding randomly to block the flowing of water from the drinking opening 12 when users drink.

Figure 3:
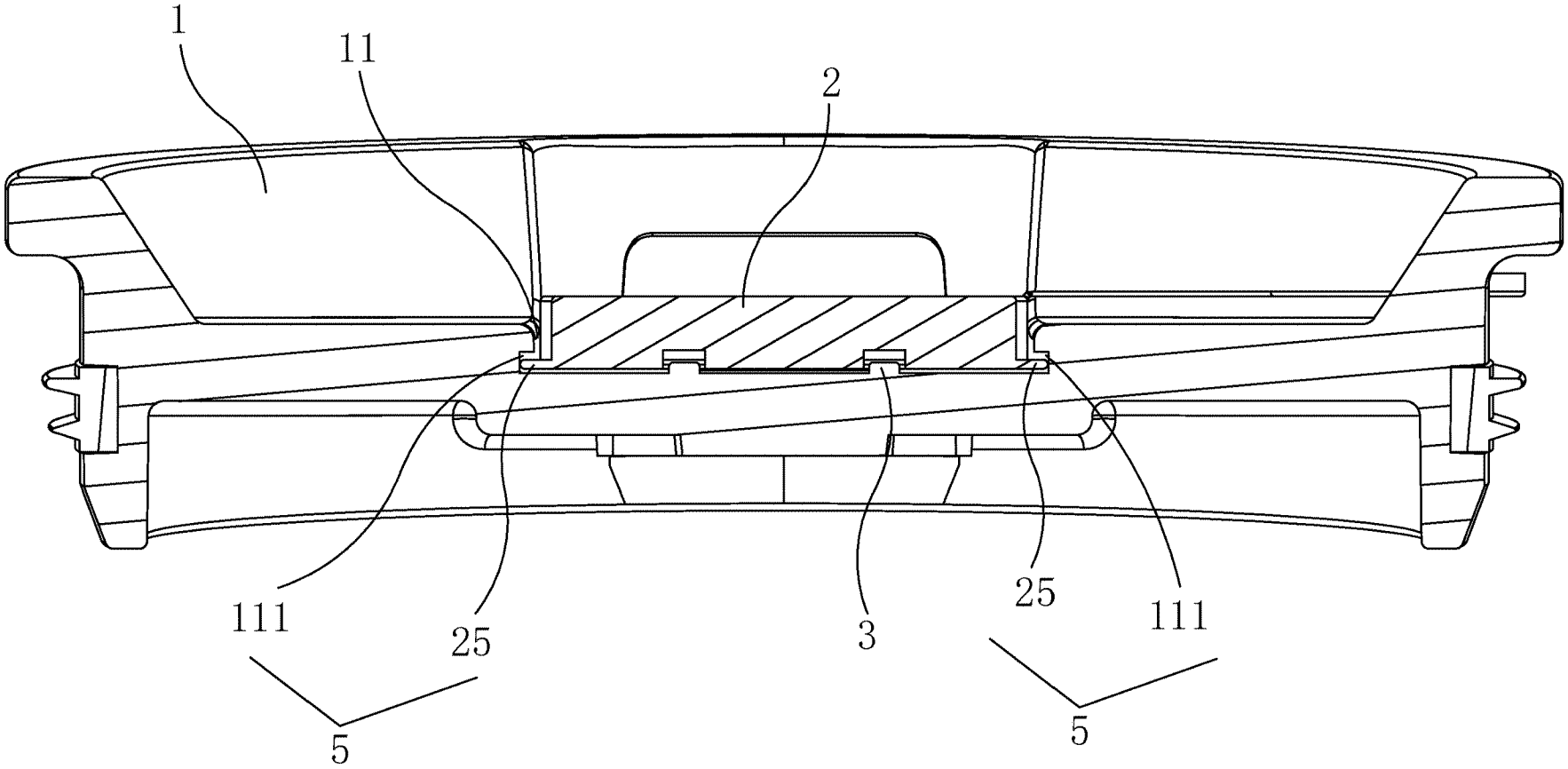
FIG. 3 is the cup lid of FIG. 2 shown in another sectional view, showing engagement of the push piece with the push piece moving groove.

As shown in FIG. 3, the push piece 2 is limited in the push piece moving groove 11 by limiting mechanisms 5, and specifically, the limiting mechanisms 5 refer to insertion pieces 25 arranged on front and rear sides of the push piece 2 respectively, and slots 111 formed on front and rear sides of the push piece moving groove 11 respectively. The push piece 2 is embedded in the push piece moving groove 11 through the insertion pieces 25 so as to be able to slide left and right in the push piece moving groove 11. Vertical lengths of the slots 111 enable the insertion pieces 25 to move up and down inside the slots 11, thus allowing the insertion pieces 25 to be lifted (pushed away from the bottom side of the push piece moving groove 11) together with the push piece 2 by the lifting mechanisms 3.

The butting parts 31 of the lifting mechanisms 3 shown in FIG. 2 are arranged on the bottom side of the push piece moving groove 11, while the lifting parts 32 are arranged oppositely on a bottom side of the push piece 2 facing towards the bottom side of the push piece moving groove 11. There is no doubt that the butting parts 31 may be arranged on the bottom side of the push piece 2, while the lifting parts 32 may be arranged oppositely on the bottom side of the push piece moving groove 11.

As shown in FIG. 4 to FIG. 11, another cup lid is provided according to the present utility model. The structure of the sealing element 4 of the cup lid is different from that of the cup lid described above, and different limiting mechanisms 5 are arranged between the lid body 1 and the push piece 2 to prevent the push piece 2 from falling off from the push piece moving groove 11. While the same is that both cup lids use the same lifting mechanisms 3 to reduce the friction against the sealing element 4 when the push piece 2 is pushed.

Figure 9:
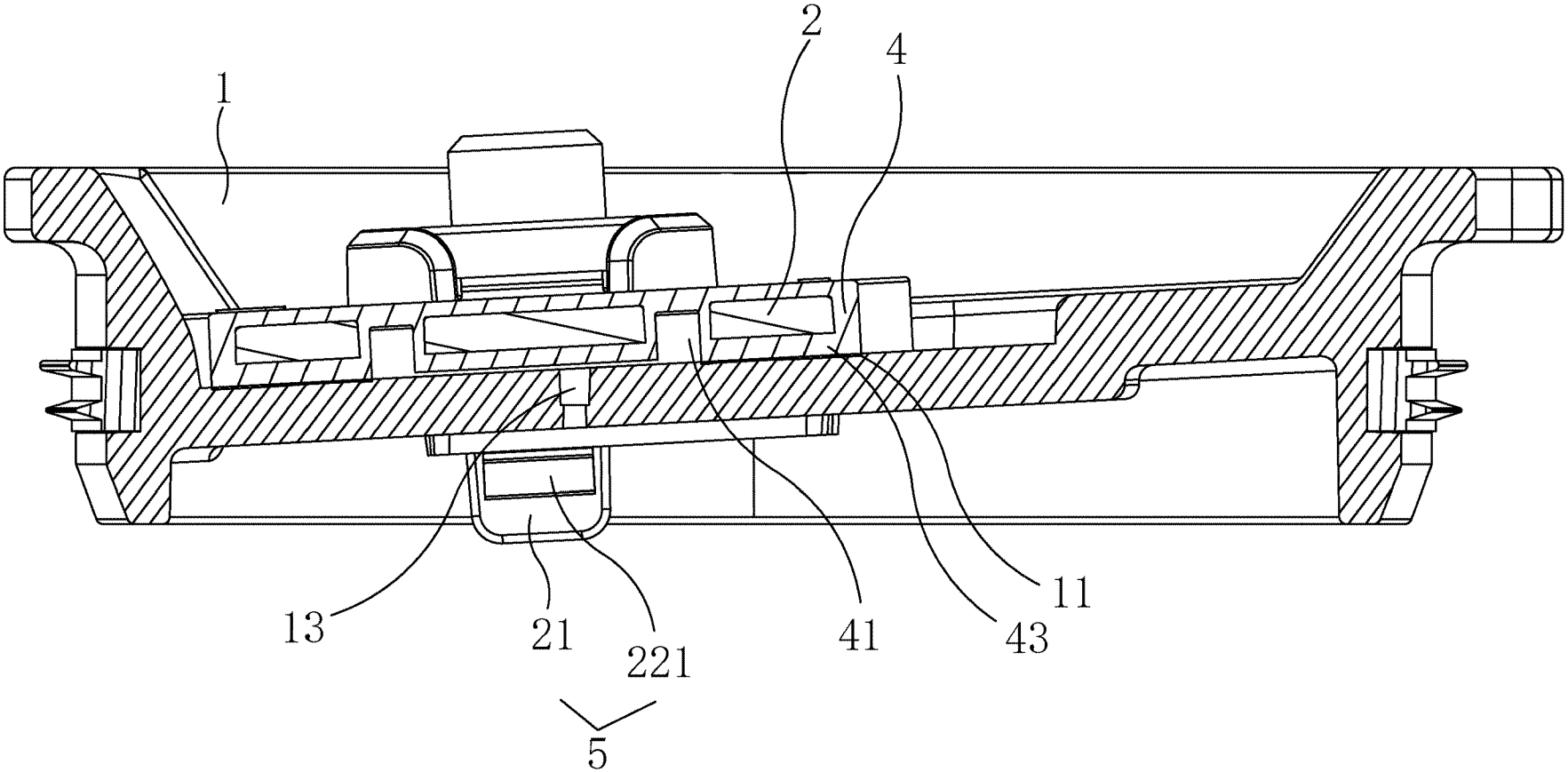
FIG. 9 is a cross-sectional view of A-A in FIG. 8.

The sealing element 4 may be a sealing silicone material, wrapping lateral sides and an upper side of the push piece 2. Referring to FIG. 9, the sealing silicone material forms a sealing ring 43 on a periphery of a bottom side of the push piece 2, and the sealing ring 43 can seal the drinking opening 12 by being in sealing contact with the bottom side of the push piece moving groove 11 at areas around the drinking opening 12.

Figure 10:
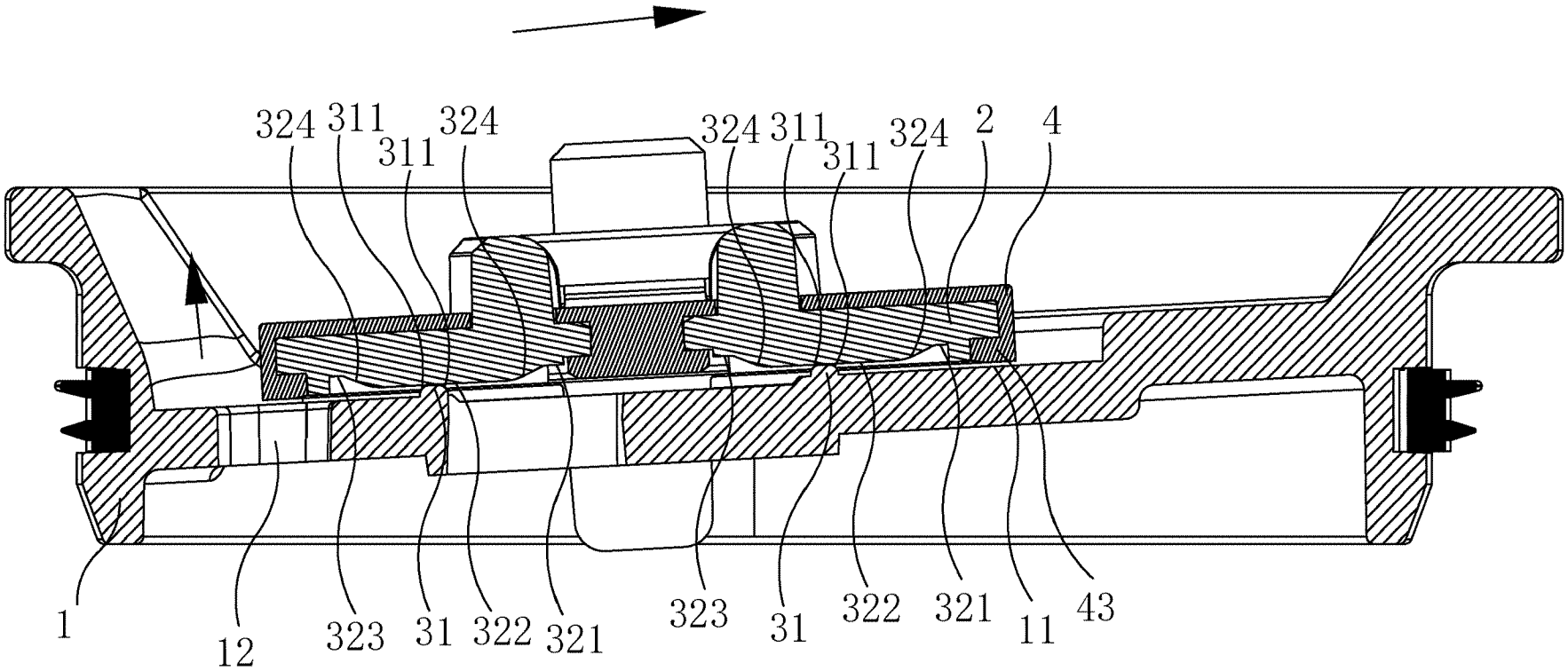
FIG. 10 is a cross-sectional view of B-B in FIG. 8, showing how the push piece is being lifted while sliding.
Figure 11:
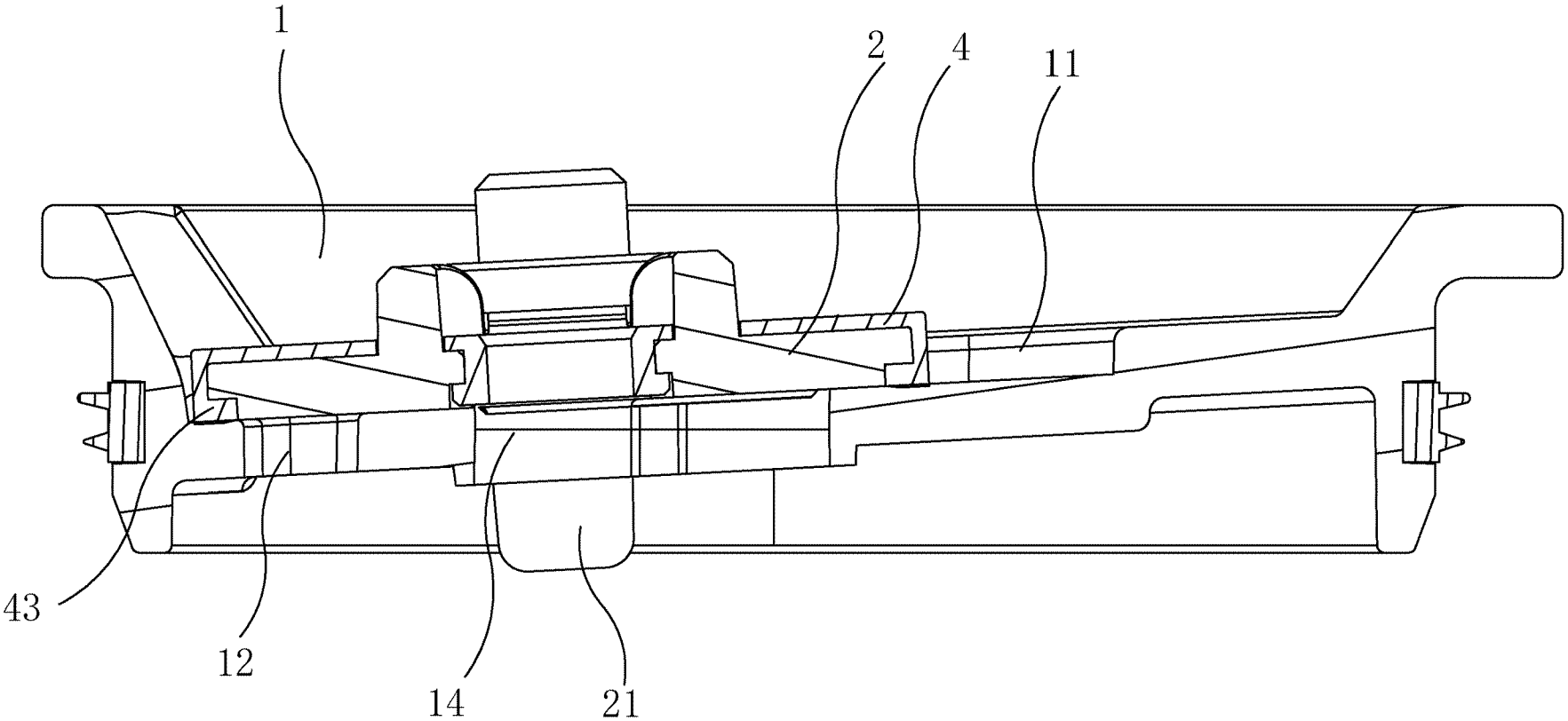
FIG. 11 is a cross-sectional view of C-C in FIG. 8.

Referring to FIG. 10, by means of the lifting mechanisms 3, the distance between the push piece 2 and the bottom side of the push piece moving groove 11 is adjusted during the pushing process to avoid the sealing part 43 of the sealing element 4 sliding against the bottom side of the push piece moving groove 11, thus enabling a non-contacting movement of the sealing element 4 on the bottom side of the push piece moving groove 11 and hence reducing the friction against the sealing element 4.

Figure 7:
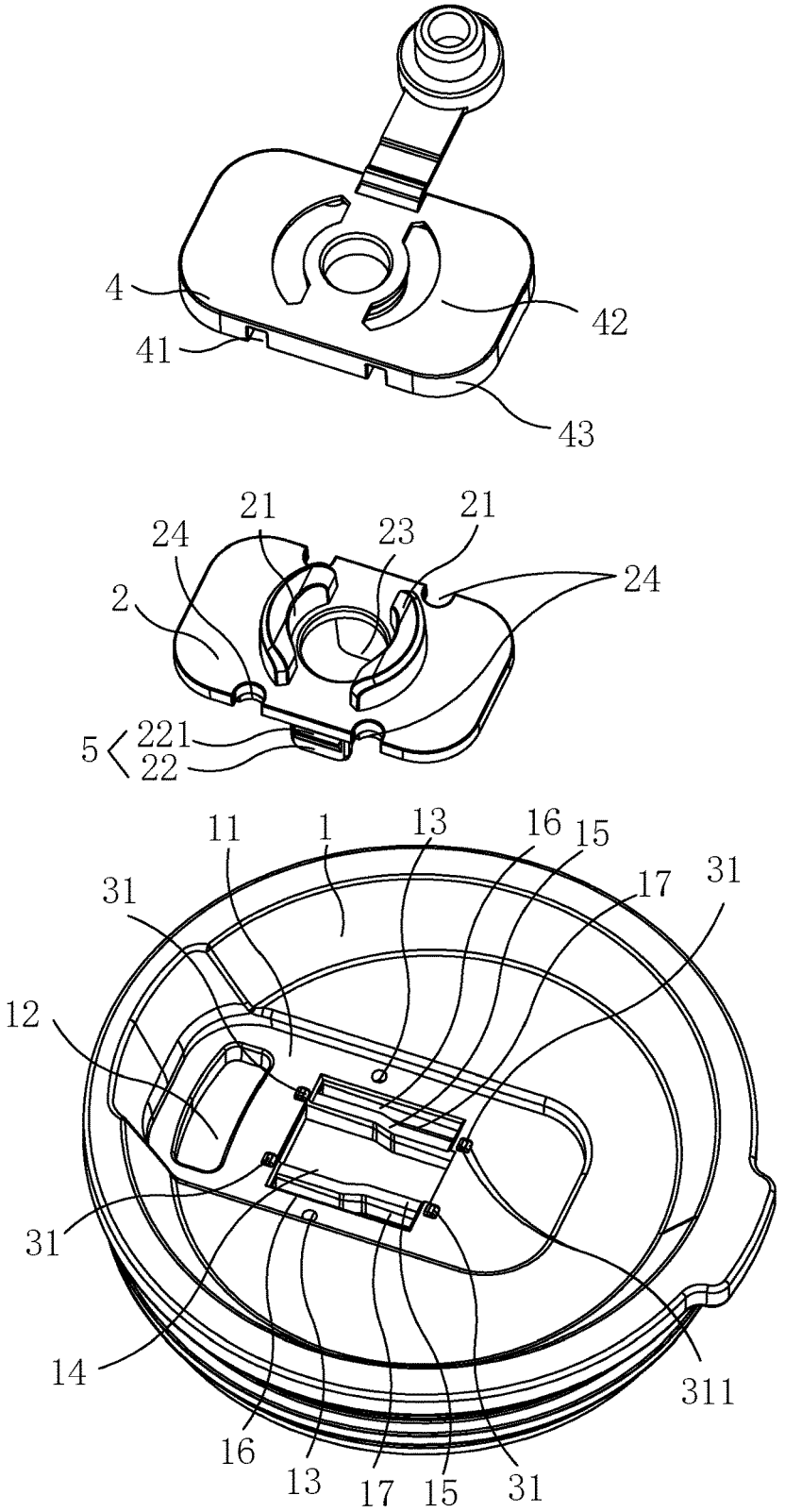
FIG. 7 is another exploded perspective view of said another cup lid according to said another embodiment of the present utility model.
Figure 8:
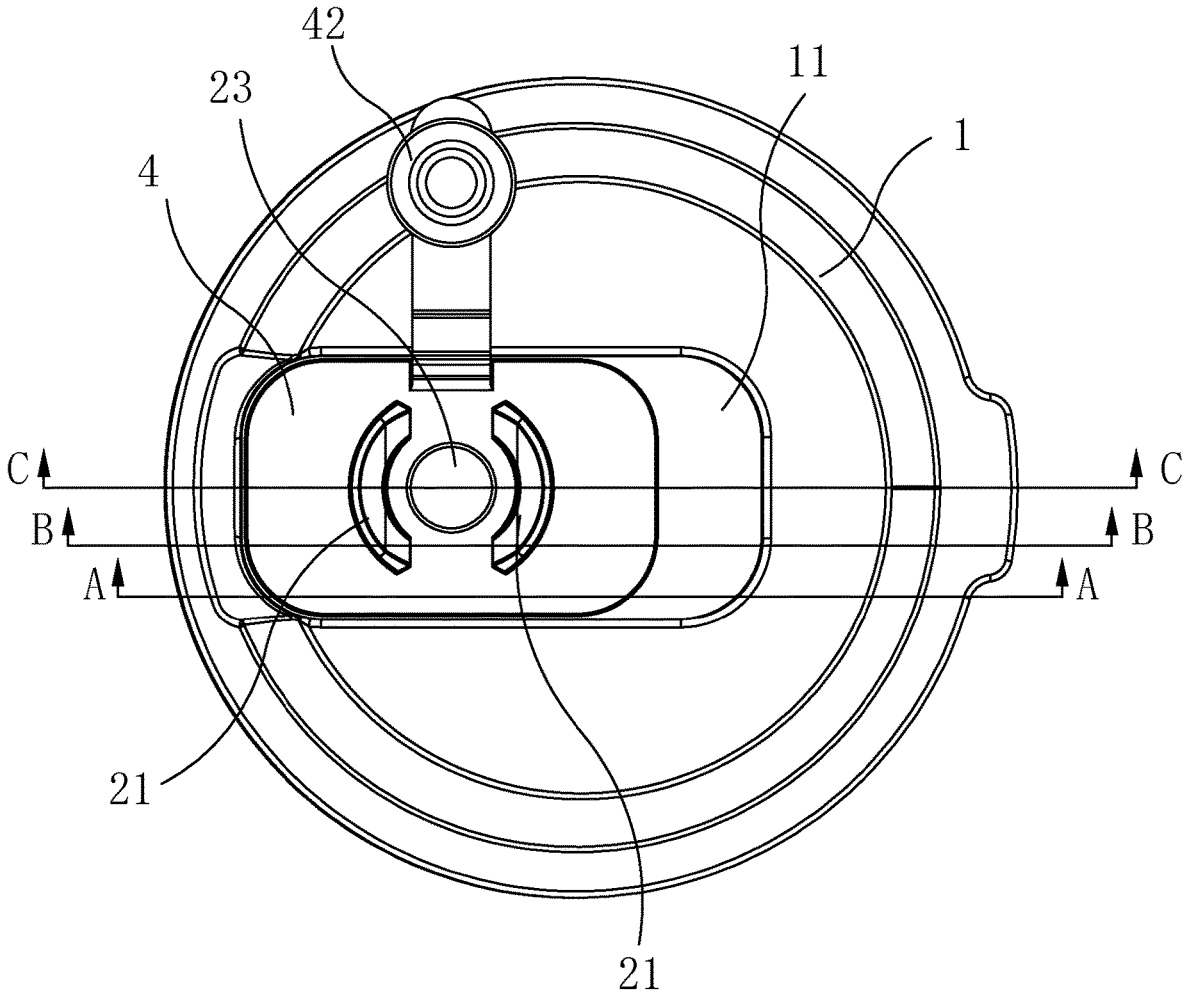
FIG. 8 is a top view of said another cup lid according to said another embodiment of the present utility model.

As shown in FIG. 7 and FIG. 9, air holes 13 are formed on the bottom side of the push piece moving groove 11 of the lid body 1, and the number of the air holes may be two. Air passages 41 communicating the air holes 13 with an external environment are formed on the sealing silicone material of the sealing element 4 at the sealing ring for gas emission from hot drinks contained in the cup to prevent the danger of gas expansion and explosion. Notches 24 are formed correspondingly on the push piece 2 to give way to the air passages 41.

Figure 6:
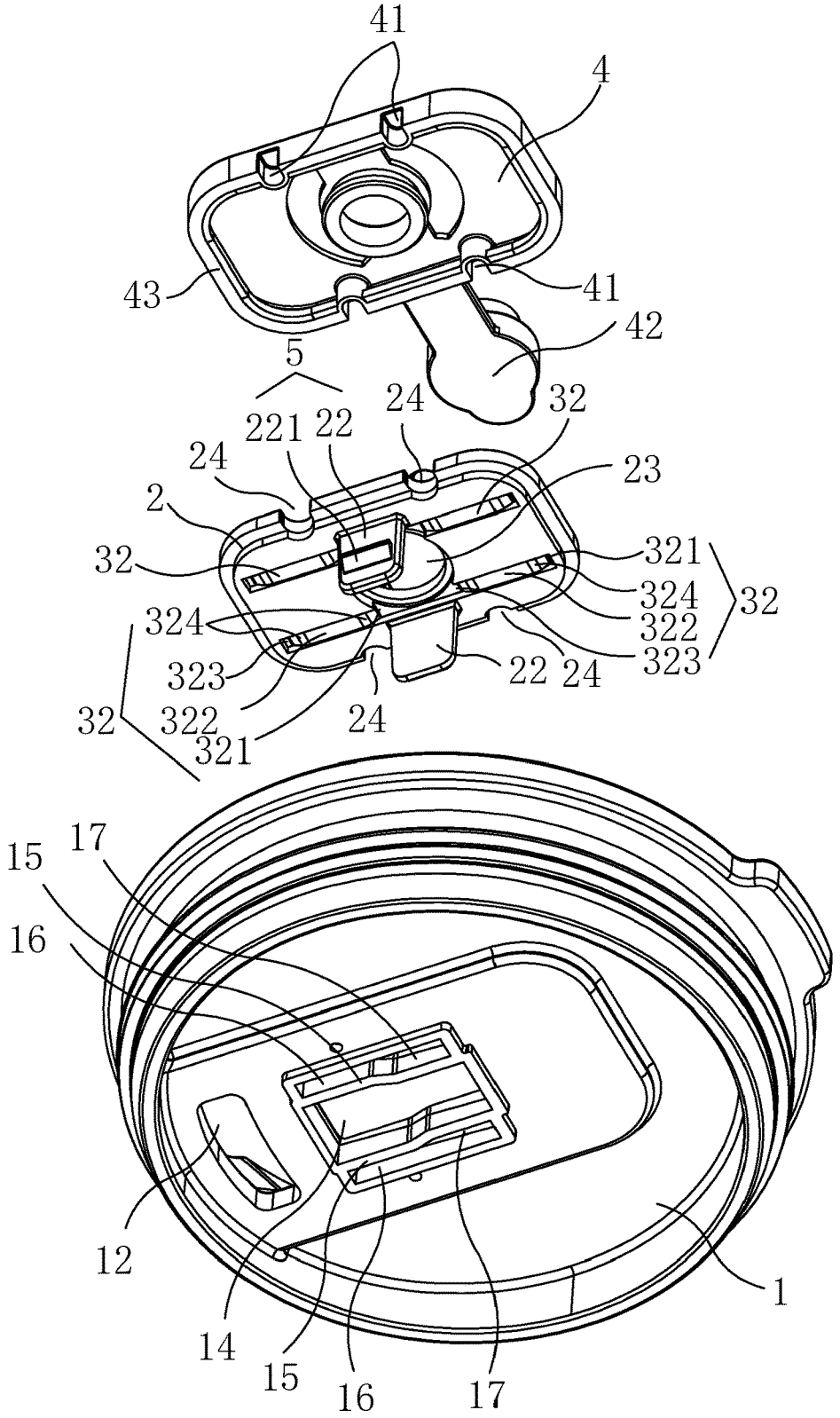
FIG. 6 is an exploded view of said another cup lid according to said another embodiment of the present utility model.

At least two sets of the lifting mechanisms 3 may be provided, and the two sets of the lifting mechanisms 3 are arranged to be spaced apart from each other along a direction perpendicular to the sliding direction of the push piece 2, so as to improve the stability of the sliding of the push piece 2. Specifically, as shown in FIGS. 6 and 7, four sets of lifting mechanisms 3 are provided; the four sets of lifting mechanisms 3 are divided into two groups, and each group contains two sets of lifting mechanisms 3; the two lifting parts 32 of the two sets of lifting mechanisms 3 in each group are arranged along a straight line corresponding to the sliding direction of the push piece 2, and the two lifting parts 32 of one group are spaced apart from the two lifting parts 32 of another group along the direction perpendicular to the sliding direction of the push piece 2, such that the two lifting parts 32 of one group and the two lifting parts of another group are arranged in two straight lines respectively corresponding to the sliding direction of the push piece 2 and the two straight lines are parallel to each other. Correspondingly, for each group containing said two sets of lifting mechanisms 3, two butting parts 31 are provided corresponding to the straight line on which the lifting parts 32 of the respective group containing said two sets of lifting mechanisms 3 are arranged, the two butting parts 31 provided corresponding to one group of said two sets of lifting mechanisms 3 are symmetrically positioned relative to the two butting parts 31 provided corresponding to another group of said two sets of lifting mechanisms 3, so that all the lifting mechanisms 3 are arranged and spaced apart evenly between the lid body 1 and the push piece 2 to ensure better stability.

Each of the lifting parts 32 is a recessed groove, and transitional surfaces 324 are formed at transitional areas between the first position 321, the second position 322, and the third position 323 of each of the lifting parts 32; the butting part 31 corresponding to each of the lifting parts 32 is a protruding knob, and curved chamfers 311 are formed on two sides of the protruding knob corresponding to the sliding direction of the push piece 2. Forming the transitional surfaces 324 and the curved chamfers 311 can reduce resistance and facilitate the sliding of the push piece 2. There is no doubt that the lifting parts 32 may be recessed areas, and the butting parts 31 may be protruding blocks.

Referring to FIG. 7, a through passage 14 is formed on a middle part of the bottom side of the push piece moving groove 11 of the lid body 1, the through passage 14 being located in a center position relative to the four lifting mechanisms 3, and specifically, the butting parts 31 may be located on two sides of the through passage 14 respectively. A through straw opening 23 communicating with the through passage 14 is formed on a middle part of the push piece 2. A removable plug 42 is arranged above the push piece 2 to seal or unseal the through straw opening 23, and a straw may be inserted through the through straw opening 23 to allow both direct drinking from the drinking opening 12 and drinking with a straw. The removable plug 42 according to the embodiment is integrally formed with the sealing silicone material.

Figure 4:
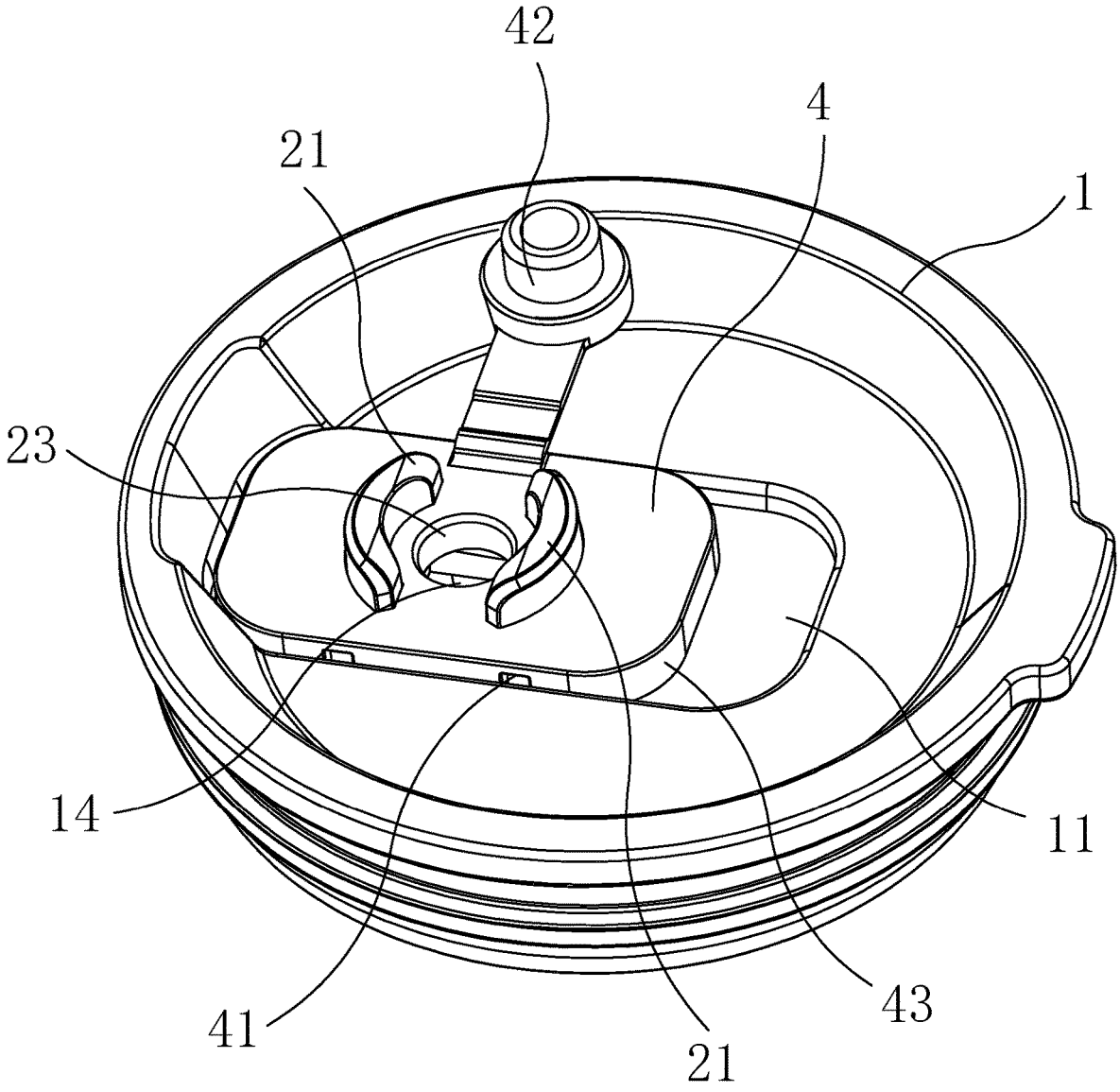
FIG. 4 is a perspective view of another cup lid according to another embodiment of the present utility model, wherein a drinking opening is in a closed state.
Figure 5:
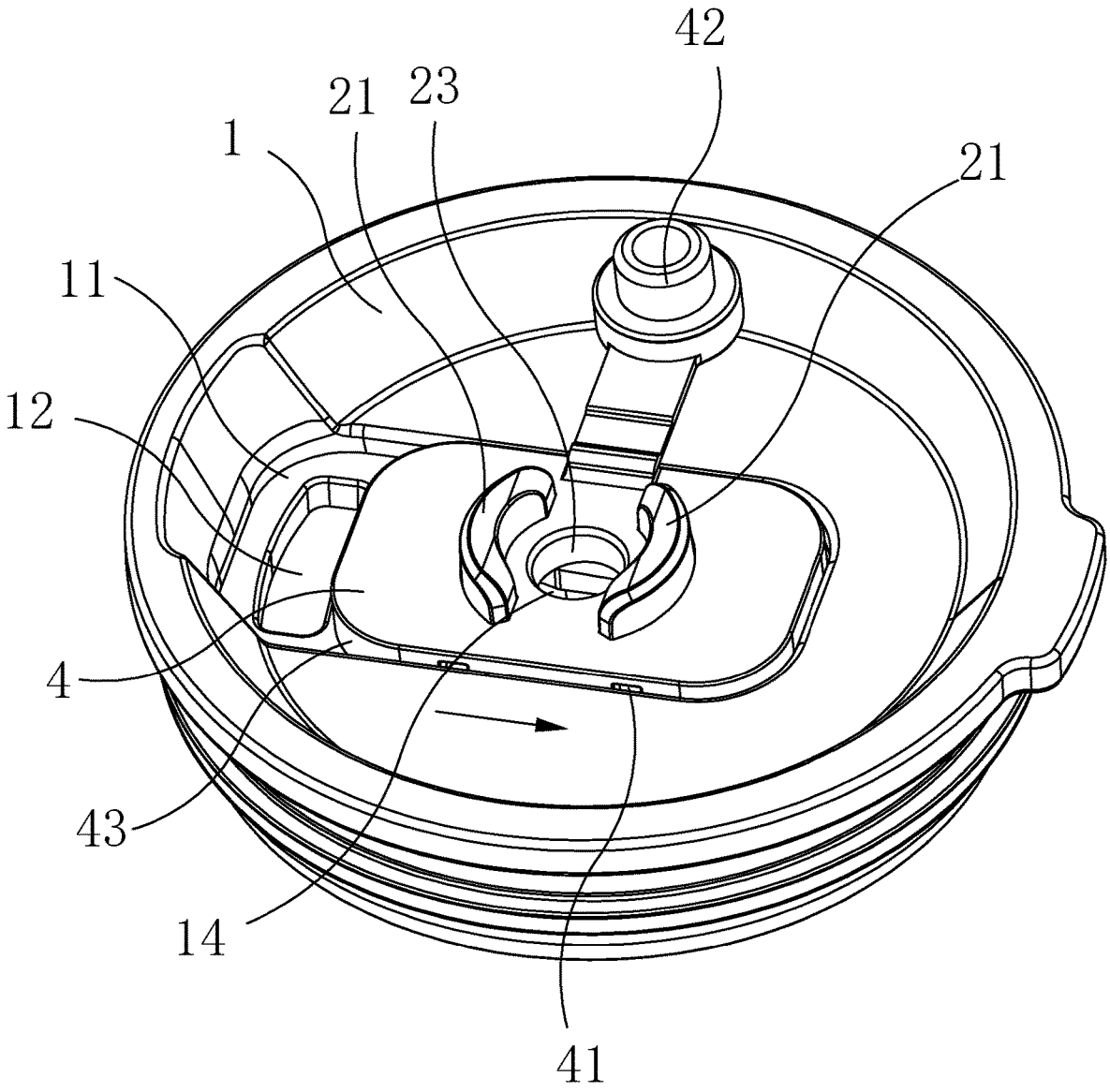
FIG. 5 is a perspective view of said another cup lid according to said another embodiment of the present utility model, wherein the drinking opening is in an opened state.

As shown in FIGS. 4 and 5, two symmetrically arranged arc-shaped protruding pieces 21 are arranged on an upper side of the push piece 2 around the straw opening 23. The removable plug 42 is installed and fixed between the arc-shaped protruding pieces 21; and the arc-shaped protruding pieces 21 protrude beyond the upper side of the push piece 2, to facilitate fingers of the user to push the push piece 2 by pushing against the arc-shaped protruding pieces 21.

As shown in FIGS. 6 and 7, the limiting mechanisms 5 comprise two sliders 22 arranged at the bottom side of the push piece 2, and two clamping pieces 221 arranged on outer sides of the sliders 22 respectively; the push piece 2 is inserted into the through passage 14 through the two sliders 22 arranged at the bottom side of the push piece 2, with the outer sides of the sliders 22 in contact with inner walls of the through passage 14, and in this way the push piece 2 is slidably assembled in the push piece moving groove 11 and slide therein; by means of the two clamping pieces 221 arranged on the outer sides of the sliders 22, the push piece 2 can be prevented from slipping out of the through passage 14. Furthermore, two ribs 15 are arranged in the through passage 14 of the push piece moving groove 11, the through passage 14 are divided by the ribs such that two through sliding passages 16 spaced apart from each other are defined between the ribs 15 and the through passage 14, the through sliding passages 16 extend lengthwise along the sliding direction of the push piece 2, and the sliders 22 extend downwards through and below the through sliding passages 16. When the push piece 2 needs to be cleaned, users may press the sliders 22 extended below the through sliding passages 16 to remove the push piece 2 from the lid body 1. Furthermore, when users press the sliders 22, the ribs 15 can provide a protection for the sliders 22 from being deformed and broken due to excessive pushing force against the sliders 22.

Referring to FIG. 6, a middle part of each of the ribs 15 is bent to make a width of a right side of a corresponding through sliding passage 16 away from the drinking opening 12 greater than a width of a left side of the corresponding sliding passage proximal to the drinking opening 12, thereby forming widened space 17 on the right side of the corresponding sliding passage 16, so that the two sliders 22 may be pressed and deformed and then disengaged from the sliding passages 16. In this way, the push piece 2 may be disassembled for cleaning and installation.

Figure 12:
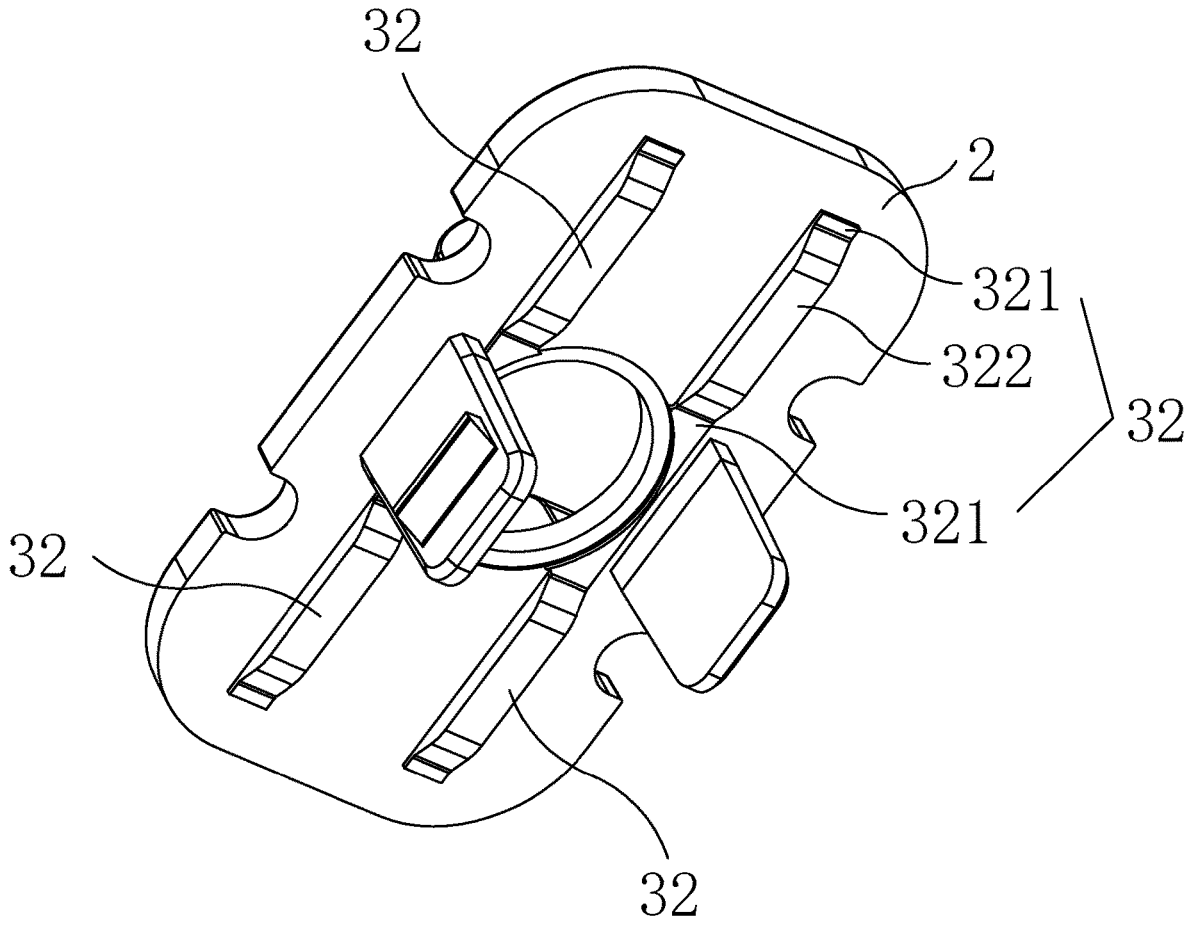
FIG. 12 is a perspective view of another embodiment of the push piece where the lifting parts are protruding structures.
Figure 13:
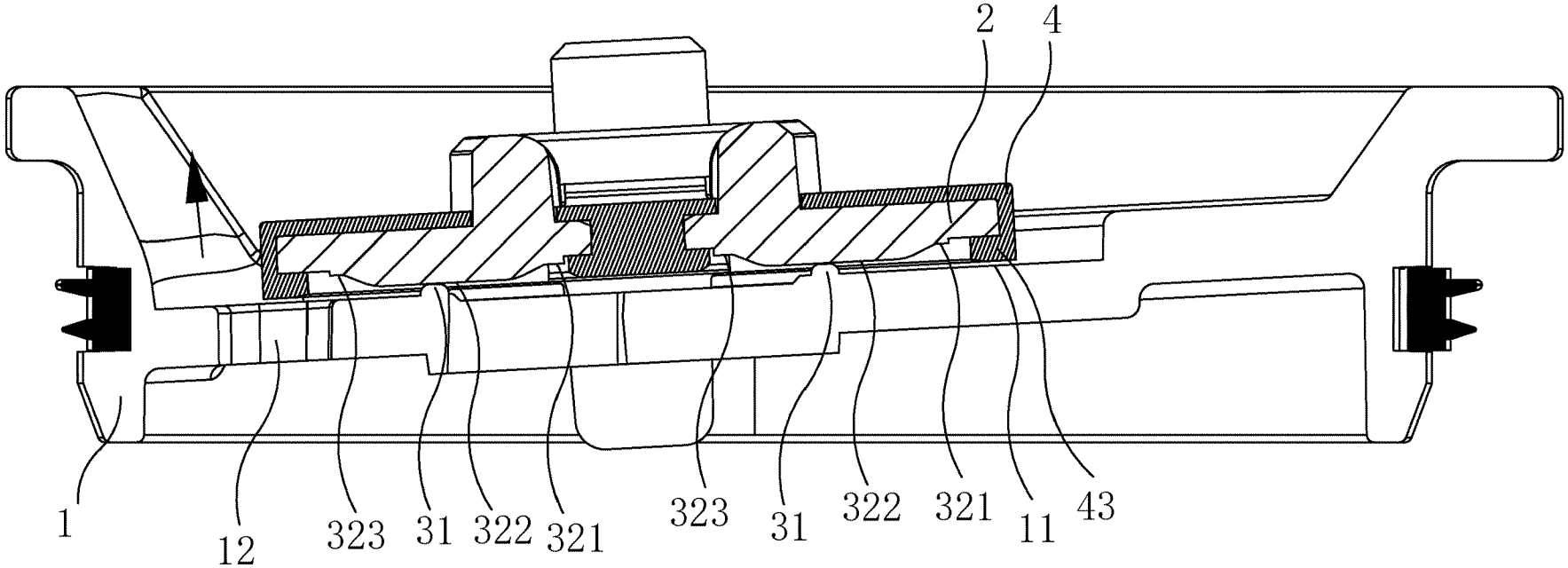
FIG. 13 is a cross-sectional view of the cup lid with the push piece structure illustrated in FIG. 12, showing how the push piece is being lifted while sliding.

Furthermore, as shown in FIGS. 12 and 13, each of the lifting parts 32 of the lifting mechanisms 3 described above may also be a protruding structure, and a protruding height of the first position 321 is smaller than a protruding height of the second position 322, so that when the butting parts 31 are at the first positions 321, the push piece 2 and the sealing element 4 are in sealing contact with the lid body 1; while when the butting parts 31 are at the second positions 322, the push piece 2 and the sealing element 4 are separated from the lid body 1. Likewise, by means of these configurations, the friction between the sealing element 4 and the lid body 1 can be reduced, frictional force can be reduced and the abrasion against the sealing element 4 can also be reduced, thus avoiding impurities falling off from the sealing element.

In summary, according to the cup lid of the present utility model, through the arrangement of lifting mechanisms 3, the push piece 2 can be lifted while being pushed to slide, so as to reduce the friction between the sealing element 4 and the bottom side of the push piece moving groove 11 and thus reduce the abrasion against the sealing element 4, therefore ensuring the convenient use of the drinking cup and a clean and hygienic drinking.

The above descriptions are only preferred embodiments of the present utility model, and the protection scope of the present utility model is not limited to the embodiments described above. All technical schemes under the idea of the present utility model all belong to the protection scope of the present utility model. It should be noted that for those of ordinary skill in the art, equivalent variations and modifications without departing from the principle of the present utility model should remain within the protection scope of the present utility model.

What is claimed is:

1. A cup lid, comprising a lid body and a push piece; a push piece moving groove is formed on the lid body; a drinking opening is formed at a bottom side of the push piece moving groove, and the drinking opening is disposed proximal to an edge of the cup lid; the push piece is slidable in a reciprocating manner in the push piece moving groove; the push piece is limited in the push piece moving groove by limiting mechanisms; the push piece is provided with a sealing element to seal or unseal the drinking opening as the push piece slides in different directions in the push piece moving groove; wherein:

the cup lid further comprises lifting mechanisms arranged between the lid body and the push piece;

the lifting mechanisms comprise oppositely arranged butting parts and lifting parts, and each of the lifting parts is provided with a first position and a second position;

when the push piece is pushed to slide in said reciprocating manner, the butting parts are positioned from being relative to the first positions of the lifting parts to being positioned relative to the second positions of the lifting parts, and vice versa; when the butting parts are positioned from being relative to the first positions to being relative to the second positions, a contact area between the lid body and the push piece together with the sealing element is reduced or eliminated;

the sealing element is a sealing silicone material wrapping lateral sides and an upper side of the push piece; the sealing silicone material forms a sealing ring on a periphery of a bottom side of the push piece;

air holes are formed on the bottom side of the push piece moving groove of the lid body; air passages communicating the air holes with an external environment are formed on the sealing silicone material of the sealing element at lateral sides of the sealing ring.

2. The cup lid of claim 1, wherein each of the butting parts is a protruding structure, whereas each of the lifting parts is a recessed structure; a depth of recess of the first position is greater than a depth of recess of the second position in each of the lifting parts.

3. The cup lid of claim 1, wherein a transitional surface is formed between the first position and the second position of each of the lifting parts.

4. The cup lid of claim 1, wherein there are at least two sets of said lifting mechanisms, and the two sets of said lifting mechanisms are arranged to be spaced apart from each other along a direction perpendicular to a sliding direction of the push piece.

5. The cup lid of claim 1, wherein there are four sets of said lifting mechanisms; and the four sets of said lifting mechanisms are arranged and spaced apart evenly between the lid body and the push piece.

6. The cup lid of claim 1, wherein each of the lifting parts further comprises a third position, and the third position is located at one end of the second position away from the first position; a depth of recess of the third position is greater than the depth of recess of the second position.

7. The cup lid of claim 1, wherein each of the butting parts is a protruding knob, and curved chamfers are formed on two sides of the protruding knob corresponding to a sliding direction of the push piece.

8. The cup lid of claim 1, wherein the butting parts are arranged on the bottom side of the push piece moving groove, while the lifting parts are arranged oppositely on a bottom side of the push piece facing towards the bottom side of the push piece moving groove.

9. The cup lid of claim 1, wherein a through passage is formed on a middle part of the bottom side of the push piece moving groove of the lid body; a through straw opening communicating with the through passage is formed on a middle part of the push piece; a removable plug is arranged above the push piece to seal or unseal the through straw opening.

10. The cup lid of claim 1, wherein a through passage is formed on a middle part of the bottom side of the push piece moving groove of the lid body; the limiting mechanisms comprise two sliders arranged at a bottom side of the push piece, and two clamping pieces are arranged on outer sides of the sliders respectively; the outer sides of the sliders are in contact with inner walls of the through passage; two ribs are arranged in the through passage, the through passage are divided by the ribs such that two through sliding passages spaced apart from each other are defined between the ribs and the through passage; the sliders are slidably received in the through sliding passages respectively.

11. The cup lid of claim 10, wherein a middle part of each of the ribs is bent to make a width of a side of a corresponding through sliding passage away from the drinking opening greater than a width of another side of the corresponding sliding passage proximal to the drinking opening, thereby forming a widened space on the side of the corresponding sliding passage away from the drinking opening.

* * * * *